US012048860B2

(12) United States Patent
Neuhaus et al.

(10) Patent No.: US 12,048,860 B2
(45) Date of Patent: Jul. 30, 2024

(54) EXERCISE APPARATUS WITH LINEAR POSITIONING SYSTEM

(71) Applicant: OxeFit, Inc., Pensacola, FL (US)

(72) Inventors: Peter Neuhaus, Pensacola Beach, FL (US); Tyson Cobb, Pensacola, FL (US); Caroline Lamb, Pensacola, FL (US); Jeremy Gines, Pensacola, FL (US)

(73) Assignee: OxeFit, Inc., Plano, TX (US)

( * ) Notice: Subject to any disclaimer, the term of this patent is extended or adjusted under 35 U.S.C. 154(b) by 0 days.

(21) Appl. No.: 17/584,245

(22) Filed: Jan. 25, 2022

(65) Prior Publication Data

US 2022/0233908 A1 Jul. 28, 2022

Related U.S. Application Data

(60) Provisional application No. 63/142,783, filed on Jan. 28, 2021.

(51) Int. Cl.
*A63B 21/078* (2006.01)
*A63B 21/062* (2006.01)

(52) U.S. Cl.
CPC ..... *A63B 21/0783* (2015.10); *A63B 21/0626* (2015.10); *A63B 2208/0252* (2013.01)

(58) Field of Classification Search
CPC ..... A63B 21/062; A63B 21/0624; A63B 21/0626; A63B 21/072; A63B 21/0724; A63B 21/078; A63B 21/0783
See application file for complete search history.

(56) References Cited

U.S. PATENT DOCUMENTS 5,048,826 A * 9/1991 Ryan ..... A63B 21/00181 482/7
5,195,935 A 3/1993 Fencel
5,823,921 A * 10/1998 Dawson ..... A63B 21/00181 482/93
6,261,205 B1 * 7/2001 Elefson ..... A63B 21/00181 482/135
6,293,892 B1 * 9/2001 Slawinski ..... A63B 21/152 482/4

(Continued)

FOREIGN PATENT DOCUMENTS

CN 212262245 U * 1/2021
GB 2 254 566 10/1992

OTHER PUBLICATIONS

International Search Report & Written Opinion in PCT/US2022/013746 dated Apr. 6, 2022, 8 pages.

*Primary Examiner* — Zachary T Moore
(74) *Attorney, Agent, or Firm* — Foley & Lardner LLP

(57) ABSTRACT

A strength training assembly includes a stand and a frame movable along the stand in a vertical direction. The frame includes a cradle configured to receive a barbell. The strength training also includes a drive system coupled to the frame and controllable to affect a velocity of the frame relative to the stand, a force sensor coupled to the frame such that the force sensor moves with the frame, the force sensor configured to provide a signal indicative of an amount of force exerted on the force sensor by a user, and a controller configured to receive the signal from the force sensor and control the drive system such that the velocity of the frame varies as a function of the amount of force exerted on the force sensor.

21 Claims, 7 Drawing Sheets

(56) References Cited

U.S. PATENT DOCUMENTS

| | | | | |
|---|---|---|---|---|
| 6,632,159 | B1 * | 10/2003 | Slattery | A63B 21/078 482/4 |
| 6,886,812 | B2 | 5/2005 | Kazerooni | |
| 7,090,200 | B2 | 8/2006 | Morse et al. | |
| 7,163,488 | B2 | 1/2007 | Anders et al. | |
| 7,963,886 | B1 * | 6/2011 | Schwinn | A63B 21/0783 482/99 |
| 11,504,570 | B2 * | 11/2022 | Neuhaus | A63B 21/002 |
| 2009/0312162 | A1 * | 12/2009 | Maiaro | A63B 21/078 482/104 |
| 2022/0062738 | A1 * | 3/2022 | Neuhaus | A63B 71/0686 |
| 2022/0401790 | A1 * | 12/2022 | Jones | A63B 21/154 |

* cited by examiner

EXERCISE APPARATUS WITH LINEAR POSITIONING SYSTEM

CROSS-REFERENCE TO RELATED APPLICATION

This application claims the benefit of and priority to U.S. Provisional Patent Application No. 63/142,783, filed 28 Jan. 2021, the entire disclosure of which is incorporated by reference herein.

BACKGROUND

Aspects of the present application relate to linear positioning systems, for example motorized or actuated positioning systems and user interaction with such systems. Additional aspects of the present application relate to exercise and rehabilitation equipment, and in particular to stands, racks, supports, etc. for use with barbells, weights, and other resistance-training, weight-training, and strength-training equipment.

For example, squat racks typically include cradles that can support a barbell. In some conventional squat racks, a pair of cradles can be manually repositioned to adjust a height at which a barbell is held when not in use. However, manually repositioning of the cradles is typically cumbersome and physically difficult (e.g., due to the weight of the cradle structure, friction, non-user-friendly design) and generally cannot be done without removing the barbell from the cradles. It may also be challenging for users of such racks to place the cradles at equal heights to avoid creating an uneven support for the barbell. In addition, the manual height adjustment of the cradles is typically limited to a limited number of discrete positions, which often do not align exactly with the ideal or preferred position for a given user and exercise. Accordingly, improved systems for position adjustment of cradles or supports for a barbell or other resistance-training equipment are desirable.

SUMMARY

One implementation of the present disclosure is a strength training assembly. The strength training assembly includes a stand and a frame movable along the stand in a vertical direction. The frame includes a cradle configured to receive a barbell. The strength training also includes a drive system coupled to the frame and controllable to affect a velocity of the frame relative to the stand, a force sensor coupled to the frame such that the force sensor moves with the frame, the force sensor configured to provide a signal indicative of an amount of force exerted on the force sensor by a user, and a controller configured to receive the signal from the force sensor and control the drive system such that the velocity of the frame varies as a function of the amount of force exerted on the force sensor.

Another implementation of the present disclosure is a linear positioning system. The linear positioning system includes a load mounted on a rail, an actuator controllable to cause movement of the load along the rail, and a force sensor rigidly coupled to the load such that the force sensor moves with the load. The force sensor is configured to measure an amount of force exerted on the force sensor by a user. The linear positioning system also includes a controller configured to control the actuator to provide the load with a velocity that varies as a function of the amount of force measured by the force sensor.

Another implementation of the present disclosure is a strength training assembly. The strength training assembly includes a stand and a frame movable along the stand in a vertical direction. the frame includes a pair of cradles configured to receive a barbell. The strength training assembly also includes an electric motor operable to provide motorized adjustment of a vertical position of the frame relative to the stand.

DETAILED DESCRIPTION

Before turning to the figures, which illustrate certain exemplary embodiments in detail, it should be understood that the present disclosure is not limited to the details or methodology set forth in the description or illustrated in the figures. It should also be understood that the terminology used herein is for the purpose of description only and should not be regarded as limiting.

Referring generally to the FIGURES, improved systems for position adjustment of cradles or supports for a barbell or other resistance-training (strength training) equipment are shown. Additionally, the linear positioning systems described herein can also be adapted for use with other types of equipment. For example, the linear positioning systems herein can be used in motorized/adjustable standing desks or tables, adjustable beds, adjustable chairs, other position-adjustable furniture. As another example, the linear positioning systems herein could be used in industrial equipment, e.g., manufacturing equipment, construction equipment, warehousing applications, etc. Many variations are within the scope of the present disclosure.

Figure 1:
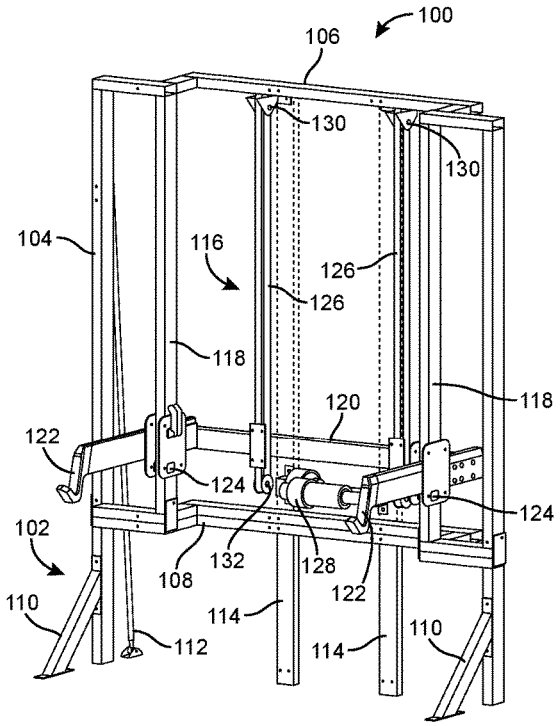
FIG. 1 is perspective view of a strength-training apparatus with a linear positioning system, according to an example embodiment.
Figure 2:
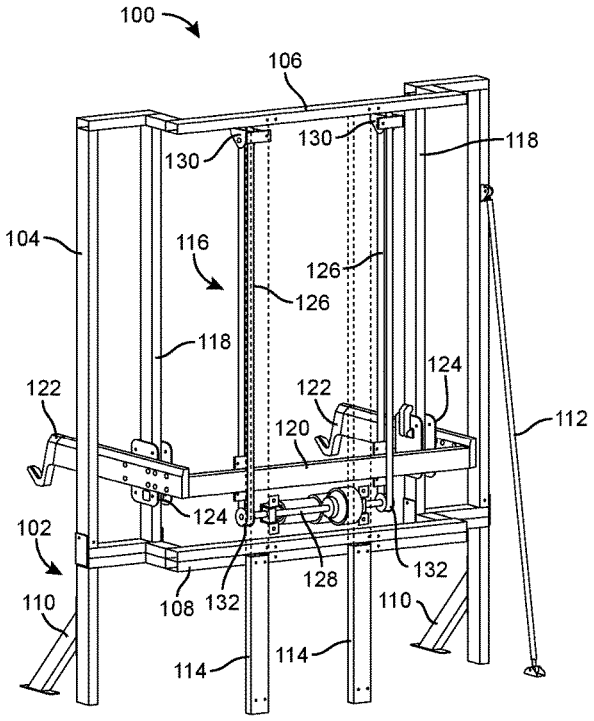
FIG. 2 is another perspective view of the strength-training apparatus of FIG. 1, according to an example embodiment.

Referring now to FIGS. 1-2, perspective views of a strength training apparatus 100 are shown, according to example embodiments. The strength training apparatus 100 is adapted for use for strength training, in particular by being adapted for supporting a barbell between exercises performed using the barbell. As described in detail below, the strength training apparatus 100 allows for intuitive and user-friendly motorized repositioning of the height at which the barbell is supported between exercises, in order to enable use of the strength training apparatus for many different exercises and for a wide range of users.

As shown in FIGS. 1-2, the strength training apparatus 100 includes a stand 102 extending in a vertical direction and providing a support structure for the strength training apparatus. The stand 102 includes vertical beams (posts) 104 connected by a top cross-piece 106 at a top end of the apparatus 100, and a middle cross-piece 108 part-way along the vertical beams 104 between a bottom of the apparatus 100 and the top cross-piece 106. The stand also includes bracing legs 110 extending diagonally downwardly from the vertical beams 104 to increase the stability of the stand 102 and prevent or substantially prevent instability of the stand 102. An anchor 112 is included with the stand 102 at an opposite side from the bracing legs 110 to add stability to the stand 102. In some embodiments, additional legs 114 extend from the middle cross-piece 108 to a floor or other surface supporting the stand 102 to provide structure support from the middle cross-piece 108. The additional legs 114 may also extend up to the top cross-piece 106 in some embodiments. The stand 102 is thereby configured as a stable, static structure configured to bear a substantial amount of weight.

According to some embodiments, the stand 102 may be made of steel or any other metal and/or any other strong and rigid material. In some embodiments, the stand 102 is formed having a height in a range between six feet and nine feet, however, it should be understood that the stand 102 may be taller or shorter. In some embodiments, the middle cross-piece 108 is positioned at a height between two feet and four feet.

The strength training apparatus 100 further comprises a linear positioning system 116. The linear positioning system 116 includes one or more rails (tracks, beams, etc.) 118 extending between the middle cross-piece 108 and the top cross-piece 106 of the stand 102. In the embodiment shown, a pair of rails 118 are included and are positioned symmetrically across a centerline of the stand 102 so as to be horizontally spaced from one another.

The linear positioning system 116 also includes a frame 120 movably mounted on the rails 118. The frame 120 has an open rectangular or u-shape such that the frame 120 extends both horizontally across the frame (spanning between the pair of rails 118) and forward in a direction normal to a plane defined by the vertical beams 104 of the stand 102. The frame 120 connects a pair of cradles (hooks, receptacles, etc.) 122. The cradles 122 are configured to receive a barbell and to support the barbell from beneath the barbell. The cradles have an angled opening to facilitate a user in positioning the barbell in the cradles 122. The frame 120 is configured to support the cradles 122 and the barbell when the barbell is held by the cradles 122. The frame 120 is rigidly designed so as to maintain the cradles 122 fixed relative to each other, thereby preventing the cradles 122 from being in uneven or misaligned positions during operation.

In the example of FIGS. 1-2, bearing assemblies 124 are included to slidably mount the frame 120 on the rails 118. The bearing assemblies 124 are shown as rigidly and statically mounted to the frame 120, while extending at least partially around the rails 118. According to some embodiments, the bearing assemblies 124 include roller bearings, ball bearings, or various other types of bearings to provide low-friction movement of the bearing assemblies 124 (and the frame 120 coupled thereto) along the rails 118. Linear motion of the frame 120 along a path defined by the rails 118 is thereby enabled. In other embodiments, the rails 118 may be curved, in which case motion of the frame 120 is enabled along a curved path defined by such rails 118.

The linear positioning system of the apparatus 100 is also shown as including a pair of belts 126 and an electric motor 128. The belts 126 are rigidly coupled to the frame 120 (e.g., using plates mounted on the belt), such that movement of the belts 126 causes corresponding movement of the frame 120. The belts 126 are formed as loops which extend around pulleys 130 mounted on the top cross-piece 106 of the stand 102 and rotors 132 of the electric motor 128. In the embodiment illustrated in FIGS. 1 and 2, for example, two belts 126 are coupled to the rotors 132; however, it should be understood that other configurations are applicable. For example, only a single belt 126 may be utilized. In other embodiments, multiple motors 128 and one or more belts 126 may be utilized on each motor 128. In still other embodiments, it should be understood that the linear positioning system may be differently configured even further. For example, instead of using a belt and pulley configuration as best illustrated in FIGS. 1 and 2, the output from the motor 128 is operable to turn a screw-drive or other gear system to raise and lower the frame 120.

The electric motor 128 is operable to create rotation of the belts 126. In the example of FIGS. 1-2, when the electric motor 128 operates to rotate the belts 126 in a first direction (e.g., clockwise), the frame 120 (and the cradles 122) moves in an upward direction along the rails 118. When the electric motor 128 operates to rotate the belts 126 in a second, opposite direction (E.g., counterclockwise) the frame 120 (and the cradles 122) moves in a downward direction along the rails 118. The electric motor may be a permanent magnetic brush direct current motor. Other types of actuators can be used in other embodiments (e.g., hydraulic or pneumatic actuators).

In some embodiments, the electric motor 128 and the belts 126 are configured to prevent movement of the frame 120 except by operation of the electric motor 128. In such embodiments, the electric motor 128 and the belts 126 are configured to hold the frame 120 in a static, selected position when the electric motor 128 is not being controlled to cause movement of the frame 120. In some embodiments, the bearing assemblies 124 include brakes or locks that prevent movement of the frame 120 along the rails 118 when movement of the frame 120 is not desired, for example when the electric motor 128 is not actively moving the frame 120 along the rails 118.

The linear positioning system 116 is configured to allow repositioning of the frame 120 to substantially any position along the rails 118, i.e., such that a user perceives the linear positioning system 116 as providing continuous rather than discrete repositioning of the frame 120. The position of the cradles 122 is thus highly customizable and modifiable for different users and for different exercises. In some embodiments, the linear positioning system 116 is controlled using force-sensitive input based on a force applied by a user. In other embodiments, a binary approach is used using a pair of buttons, such as, for example, one for up and one for down, to allow user control of the linear positioning system 116.

A range of motion of the frame 120 may also be large enough to enable a large range of exercises using the apparatus 100. In the example shown, the frame 120 can be driven along substantially a full length of the rails, i.e., from a position proximate the middle cross-piece 108 to a position proximate the top cross-piece 106. In the embodiments shown, this allows the cradles 122 to be repositioned to highest position suitable for initiation of squat or shoulderpress type exercises using a barbell held by the cradles 122 (e.g., up to approximately seven feet above the floor)), and to a lowest position suitable for a bench press exercise (e.g., down to approximately three feet above the floor). In other embodiments, the apparatus 100 may be configured such that a lower end of a range of motion of the cradles 122 enables initiation of a deadlift-type activity using a barbell held by the cradles (e.g., down to less than one foot above the floor). In various embodiments, the frame 120 has a range of motion in a range between approximately three feet and approximately six feet, although the range of motion may longer or shorter. The strength training apparatus 120 can thereby be used in a wide range of exercise by users of various heights.

In the example of FIGS. 1-2, the linear positioning system 116 is configured to provide motorized repositioning of the frame 120 relative to the stand 102 while the cradles 122 hold weights, for example a barbell with additional plates positioned on the ends of the barbell. In some embodiments and when used with conventional weights, the electric motor 128 is sufficiently powerful to move up to several hundred points (e.g., three hundred pounds, four hundred pounds, etc.) in either an upward or downward direction. Thus, the strength training apparatus 100 allows for changing the height of the cradles 122 without removing plates from the barbell or removing the barbell from the cradles 122. This can allow a user to easily make adjustments after weight has been added, for example making it much easier to adjust to different heights for different users (e.g., for users of different heights alternating sets using the same apparatus 100). This feature could also enable a user to add weights without needing to lift plates to a higher or highest position of the bar, before raising the weights using the linear positioning system 116. The strength training apparatus 100 thereby provides an advantageous solution for many of the challenges of existing squat racks.

Figure 3:
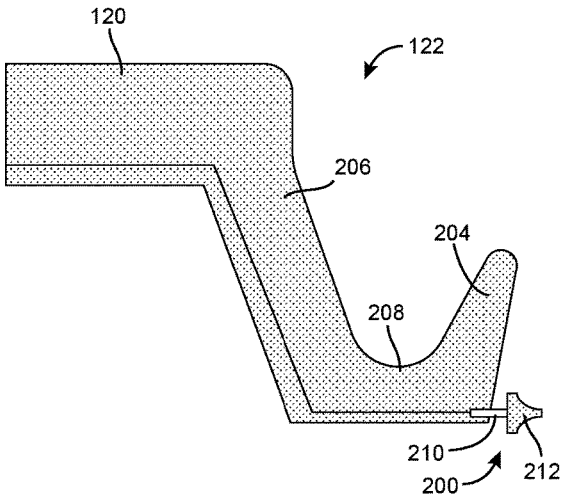
FIG. 3 is a side view of a bar cradle with an input assembly for use with the strength-training apparatus of FIG. 1, according to an example embodiment.

Referring now to FIGS. 2-3, close-up views of a cradle 122 having a user input assembly 200 are shown, according to example embodiments. In particular, FIG. 3 shows a side view of the cradle 122 and user input assembly 200, while FIG. 4 shows a perspective view of the cradle 122 and the user input assembly 200 with a barbell 202 received by the cradle 122.

From the side-view shown in FIG. 3, the cradle 122 has a hook-shape including a front lip 204, a back ramp 206, and a curved bottom 208 joining an inside of the front lip 204 to the back ramp 206. The back ramp 206 is higher than the front lip 204. The cradle 122 is thereby configured to allow a user to easily engage a barbell 202 with the back ramp 206 and slide the barbell 202 down the back ramp 206 to the curved bottom 208, where the barbell 202 will sit in and mate against the curved bottom 208 while the front lip 204 retains the barbell 202 in the cradle 122. Various designs of the cradle 122 to facilitate easy removal of the barbell 202 from the cradle 122 and return of the barbell 202 to the cradle 122 are possible in various embodiments.

Figure 4:
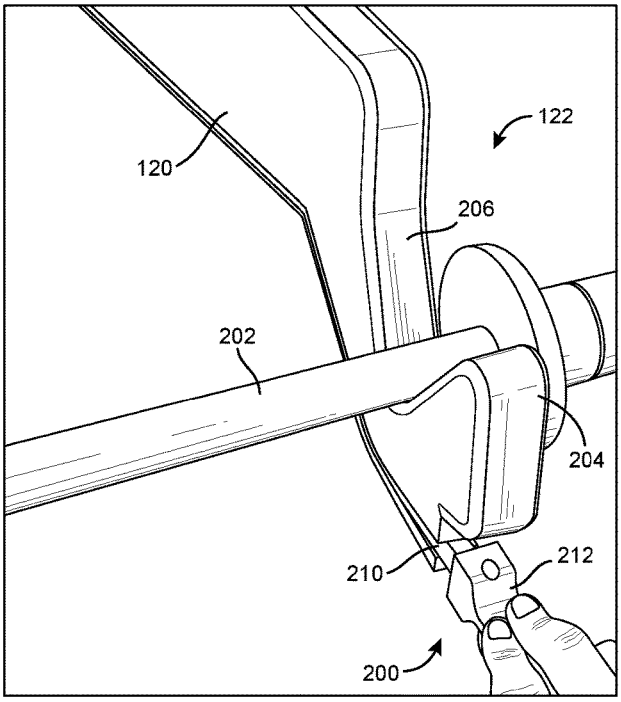
FIG. 4 is perspective view of the bar cradle and input assembly of FIG. 3, according to an example embodiment.

FIGS. 3-4 show that apparatus 100 and linear positioning system 116 as including a user input assembly 200. The user input assembly 200 includes a force sensor 210 and a cap (handle, cover, etc.) 212. The user input assembly 200 extends from a bottom of the front lip 204 of the cradle 122 in a direction parallel with the cradle 122 (e.g., normal to plane defined by vertical beams 104 of the stand 102). In the example shown, one user input assembly 200 is included in the apparatus 100. In other embodiments, multiple user input assemblies 200 are included (e.g., one on each cradle 122, on the stand 102 or even remotely).

As shown, the cap 212 is connected to the cradle 122 via the force sensor 210. In the example shown, the force sensor 210 is substantially rigid and coupled to the cradle 122 so as to be static relative to the cradle 122. A force exerted by a user on the user input assembly 200 thus creates and equal-and-opposite force of the cradle 122 pushing back on the user, without perceptible movement of the cap 212 relative to the cradle 122. The force sensor 210 is thus arranged to measure external forces exerted on the cap 212 by a user.

In the example shown, the force sensor 210 includes a strain gauge or other type of force sensor configured to generate a signal indicative of both a magnitude and sign (indicating direction) of the force exerted by a user on the user input assembly 200. In various other embodiments, the force sensor 210 can be a pressure sensitive button, a spring with deflection sensor, or some other type of force sensor. The user input assembly 200 is thereby configured to determine whether a user is pushing up or down on the user input assembly 200 and to determine an amount of force applied by the user on the user input assembly 200.

Figure 5:
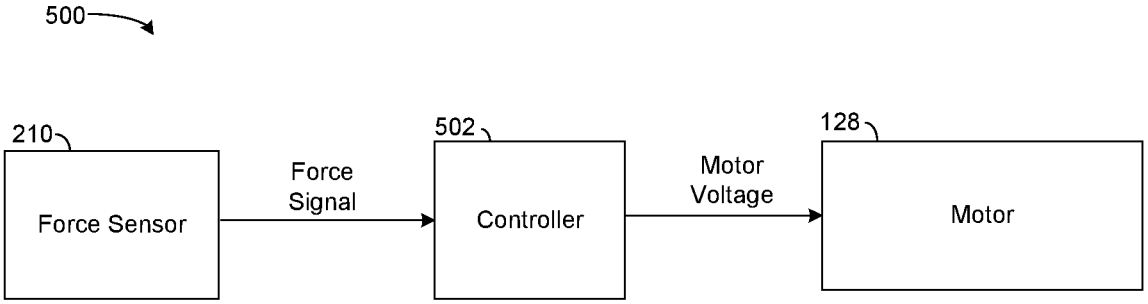
FIG. 5 is a block diagram of a linear positioning system, according to an example embodiment.

Referring now to FIG. 5, a block diagram of an example embodiment of a linear positioning system 500 is shown, according to an example embodiment. The linear positioning system 500 of FIG. 5 may be an example implementation of the linear positioning system 116 (or a portion thereof) of FIGS. 1-4, and reference is made to the strength training apparatus 100 in the description of FIG. 5 herein. The linear positioning system 500 can also be implemented with other hardware or systems, including in the context of other equipment or furniture in addition to strength training apparatuses, and all such adaptations are within the scope of the present disclosure. For example, a motor or other actuator could be controlled to move other loads as alternatives to the frame 120 as may be advantageous in various implementations.

As shown in FIG. 5, the linear positioning system 500 includes the force sensor 210, a controller 502, and the motor 128. In other embodiments, the motor 128 is replaced by a different type of actuator. The force sensor 210 is electrically communicable with the controller 502 (e.g., connected thereto by a wire or other conductive path, wirelessly communicable or otherwise) and the controller 502 is electrically communicable with the motor 128 (e.g., connected thereto by a wire or other conductive path, wirelessly communicable or otherwise).

In various embodiments, the controller 502 is formed as circuitry mounted on the strength training apparatus 100, provided inside a housing of the motor 128, or otherwise provided onboard the strength training apparatus 100. In some embodiments, the controller 502 is included as part of a computing and processing system that controllers other elements of a strength training system, for example a cable-based force production system as described with reference to FIG. 10 below.

The controller 502 may include one or more processors and non-transitory computer readable media storing program instructions executable by the one or more processors to perform the various operations described herein. For example, the hardware and data processing components used to implement the controller 502, other computing components and methods described herein may include a general purpose single- or multi-chip processor, a digital signal processor (DSP), an application specific integrated circuit (ASIC), a field programmable gate array (FPGA), or other programmable logic device, discrete gate or transistor logic, discrete hardware components, or any combination thereof designed to perform the functions described herein. A general purpose processor may be a microprocessor, conventional processor, or state machine. A processor also may be implemented as a combination of computing devices, such as a combination of a DSP and a microprocessor, a plurality of microprocessors, one or more microprocessors in conjunction with a DSP core, or any other such configuration. In some embodiments, particular processes and methods may be performed by circuitry that is specific to a given function. Controllers herein may include computer-readable media (e.g., memory, memory unit, storage device), which may include one or more devices (e.g., RAM, ROM, Flash memory, hard disk storage, EPROM, EEPROM, other optical disk storage, magnetic disk storage or other magnetic storage devices, any other medium which can be used to carry or store desired program code in the form of machine-executable instructions or data structures, combinations thereof) for storing data and/or computer code for completing or facilitating the various processes, layers and modules described in the present disclosure. The memory may be or include volatile memory or non-volatile memory, and may include database components, object code components, script components, or any other type of information structure for supporting the various activities and information structures described in the present disclosure. According to an exemplary embodiment, the memory is communicably connected to the processor via a processing circuit and includes computer code for executing (e.g., by the processing circuit or the processor) the one or more processes described herein. The controller 502 includes an internal clock and/or standard capabilities for measuring passage of time in a computer system. Although FIG. 5 shows the controller 502 as a discrete computing system, in some embodiments features attributed herein to the controller 502 are performed at a remote server and/or onboard a user's personal device (e.g., a smartphone or tablet of a user).

As shown in FIG. 5, the force sensor 210 is configured to generate a force signal indicative of a magnitude and direction of a force exerted on the force sensor 210. The force signal may be an analog signal, with a magnitude proportional to the magnitude of force measured by the force sensor 210 and sign indicative of the direction of the force (e.g., positive indicating up and negative indicating down or vice versa), or a digital signal. The force sensor 210 may provide a substantially continuous signal to the controller 502, so that the controller 502 continuously receives a real-time indication of the force exerted on the force sensor 210. Various signal processing techniques (filtering, smoothing, amplifying) can be used to improve the user experience and performance of the linear positioning system 500.

In the example of FIG. 5, the controller 502 is configured to output a motor voltage for the motor 128 based on the force signal from the force sensor 210. The controller 502 can determine the motor voltage for the motor 128 using a program, algorithm, function, etc. configured to provide a velocity of the frame 120 (or other frame or member moved by the motor 128 in various embodiments) that varies as a function of the magnitude and sign of the force signal. The controller 502 may determine the amount of voltage to provide to the motor 128 (e.g., as a percentage of total capacity) by applying a function to the magnitude of the force signal. The function may be based on a known or predetermined relationship between velocity of the frame and motor voltage. The controller 502 may determine a sign of the motor voltage to be provided to the motor 128 based on the sign of the force signal.

In some embodiments, for example, the function is configured such that the absolute value of the motor voltage and of the velocity of the frame increase as a magnitude of the force increases. In such embodiments, the user can apply more force to the force sensor 210 to cause the frame 120 to move faster, and apply less force to the force sensor 210 to cause the frame 120 to move slower. When zero force is applied to the force sensor 210, the velocity of the frame (and the voltage applied to the frame) is zero.

In some embodiments, the function is an exponential function. For example, the controller 502 may use a function $|V|=C|f|^x$, where V is the motor voltage selected from the set $-100\% \leq V \geq 100$, f is the force, C is a constant scaling factor, and x is an exponential factor that varies in different embodiments. As another example, the controller 502 may use a function $|v|=C|f|^x$, where v is velocity of the frame, along with another process mapping velocity to voltage. In such examples, the exponential factor x is preferably greater than one (e.g., 1.5, 2, 3, etc.), such that the velocity of the frame increases non-linearly with increased force. This can allow for fine, highly accurate repositioning of the frame when low amounts of force are provided, while also enabling relatively quick gross repositioning of the frame when large movements are desired.

In some embodiments, the controller 502 is configured to provide a deadband around zero force, such that the motor voltage (and the velocity) is kept at zero unless the magnitude of the force exceeds a threshold magnitude, at which point the motor voltage and velocity can start to increase from zero. The deadband may or may not be symmetric around zero, in various embodiments. The deadband can prevent the controller 502 from responding to environmental fluctuations, sensor noise, etc. and can help avoid other undesirable control behaviors. An example function that can be used by the controller 502 is shown in a graphical form in FIG. 9 and described in detail with reference thereto below.

FIG. 5 thus shows that a motor voltage for the motor 128 is varied by the controller as a function of a force signal from the force sensor 210. This arrangement allows for a highly intuitive interaction between a user and the linear positioning system 116. Because the force sensor 210 is statically mounted on the frame 120 such that the force sensor 210 moves with the frame 120, the perceived effect of this input and control modality for the user is that users perceive themselves as pushing the frame 120 in the direction that the user desires the frame 120 to move. A user is able to easily track the user input assembly 200 with the user's hand, maintaining contact and control with the user input assembly 200 as the frame 120 is moved.

Additionally, by mapping force input to velocity output, an intuitive relationship is established between the user input and the movement of the frame 120. Other embodiments contemplated by the present disclosure include using the controller 502 and motor 128 for force multiplication, i.e., controlling the motor 128 to provide as multiple of the user's input force (e.g., F=k*f, where F is the force output by the motor, f is the measured input force, and k is a scaling factor greater than one). Although such an approach may be used in some embodiments of the present application, the movement of the frame 120 in such embodiments is dependent upon the weight of the frame 120 (i.e., its own gravitational forces which resist upward motion and increase downward motion) and the variable weight that may be supported by the cradles 122. The mapping of force to velocity (or proxy for velocity such as voltage) by the controller 502 as described above allows for a user to control the motion of the frame 120 with the same effects in either direction (up or down) and substantially regardless of the weight supported by the frame 120 at any given point in time. Additionally, linking applied force to frame velocity (as compared to force/load) provides a more stable and controllable system and relatively simple implementation in hardware.

Although the primary examples herein relate to linear system, the control approaches described herein could also be applied along a curved path or in multiple dimensions. For example, force sensors could be used to measure applied force in multiple degrees of freedom and can be used as input for control of velocity of a load in the corresponding degrees of freedom. For example, movement in a plane could be controlled in this manner.

Figure 6:
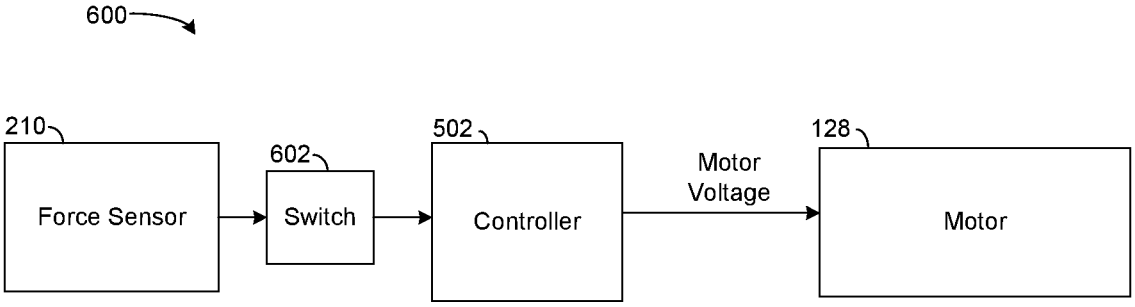
FIG. 6 is another block diagram of a linear positioning system, according to an example embodiment.

Referring now to FIG. 6, another linear positioning system 600 is shown, according to an example embodiment. In the example of FIG. 6, the linear positioning system 600 includes the force sensor 210, controller 502, and motor 128 as described above with reference to FIG. 5. The linear positioning system 600 varies from the linear positioning system 500 by including a switch 602 between the force sensor 210 and the controller 502.

The switch 602 is configured to selectively connect and disrupt the connection between the force sensor 210 and the controller 502. In the example of the linear positioning system 600 of FIG. 6, the controller 502 will receive no (zero) force signal from the force sensor 210 when the switch 602 is open and the connection therebetween is broken. Accordingly, the controller 502 will control the motor 128 to hold the frame 120 in a constant position while the switch 602 is open. When the switch 602 is closed, thereby connecting the force sensor 210 and the controller 502, the controller can receive the force signal from the force sensor 210 and operate as described above.

In some embodiments, the switch 602 is a physical switch, button, sensor, or other input device which can be selected (closing the switch 602) when the user wants to use the linear positioning system 600 to reposition the frame 120, and unselected (opening the switch 602) when the user wants the frame 120 to stay in its position. The switch 602 can be positioned somewhere on the stand 102 or the frame 104 to enable user selection of the switch 602.

In other embodiments, the switch 602 is triggered by other software logic or sensors. For example, the switch 602 may be connected to sensors, tracking systems, force-production systems (e.g., as in FIG. 10, described below), in order to disable the linear positioning system 600 while an exercise is actively being performed at the apparatus 100. The switch 602 may thus avoid inadvertent repositioning of the frame 120 during an exercise. As another example, the switch 602 may be communicable with an authentication system which requires a user to verify the user's identity and/or access privileges before the linear positioning system 600 can be used to operate the motor 128. Many such variations of the switch 602 are possible.

Figure 7:
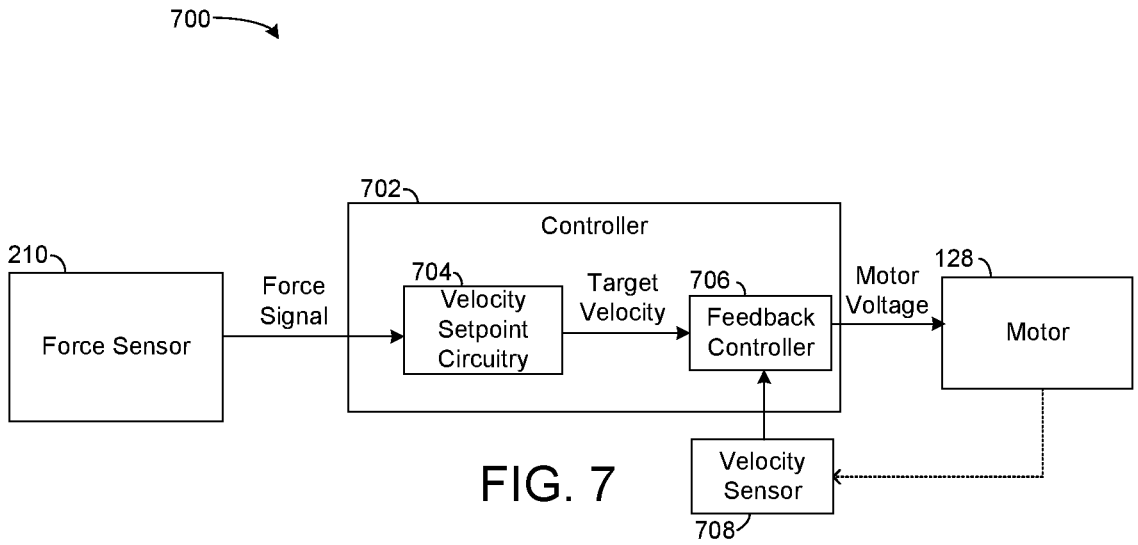
FIG. 7 is another block diagram of a linear positioning system, according to an example embodiment.

Referring now to FIG. 7, a linear positioning system 700 is illustrated according to an exemplary embodiment. The linear positioning system 700 includes the force sensor 210 and the motor 128, as in the linear positioning system 500 described above. FIG. 7 shows that the linear positioning system 700 includes a controller 702, which is a variation on the controller 502 described above. In particular, the controller 702 is enabled or otherwise configured to use feedback control to improve an accuracy of the mapping of the force measured by the force sensor 210 to velocity of the frame 120.

The linear positioning system 700 is also shown as including a velocity sensor 708 to enable the feedback control. The velocity sensor 708 can be included with the motor 128 to measure velocity by counting rotations, for example, or may be positioned on the frame 120 and/or belt 126 to measure velocity in another way, such as, for example, using an inertial sensor.

As shown in FIG. 7, the controller 702 includes setpoint circuitry 704 which receives the force signal from the force sensor 210 and outputs a target velocity. The setpoint circuitry 704 can use various functions, algorithms, programs, operations, etc. to generate a target velocity. For example, in some embodiments, the target velocity is determined using a function having the form $v_{target}=S*C(|f|-f_{threshold})^x$, where v is velocity of the frame, f is the force signal, C is constant scaling factor, x is an exponential factor (preferably greater than one as described above), $f_{threshold}$ is a threshold value which defines the deadband and s determines the direction based on the sign of the force input and implements a deadband, e.g., s=

$$\begin{cases} -1, & f < -f_{threshold} \\ 1, & f > f_{threshold} \\ 0, & -f_{threshold} \le f \le f_{threshold} \end{cases}.$$

Various other examples are possible in different embodiments. For example, in some embodiments, the controller 702 uses the function graphically represented in FIG. 10 or a variation thereof.

The setpoint circuitry 704 supplies the target velocity to the feedback controller 706. The feedback controller 706 receives the target velocity and a measured velocity from the velocity sensor 708, and controls the motor 128 to drive the measured velocity toward the target velocity. For example, proportional-integral-derivative control or some other known feedback control approach can be used by the feedback controller 706. In some embodiments, the feedback controller 706 uses a stored mapping of target velocity to motor voltage as a starting place, and then refines the motor voltage using the measurements from the velocity sensor 708, in order to minimize an error between the measured velocity and the target velocity. These features enable the linear positioning system 700 to adjust for different gravitational loads on the frame 120 and/or compensate for any other variations that can affect the relationship between motor voltage and velocity.

Figure 8:
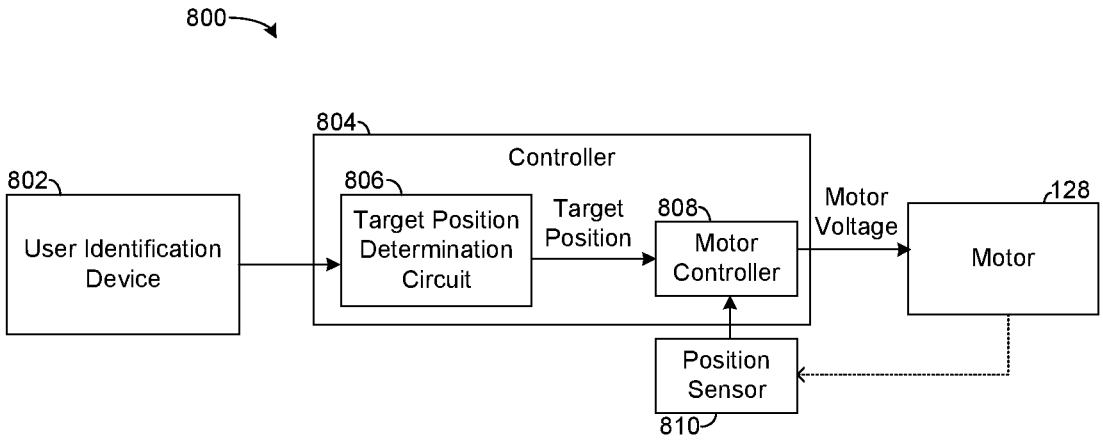
FIG. 8 is another block diagram of a linear positioning system, according to an example embodiment.

Referring now to FIG. 8, a linear positioning system 800 is shown, according to an example embodiment. The linear positioning system 800 is shown a user identification device 802, a controller 804, the motor 128, and a position sensor 810. The linear positioning system 800 is an embodiment in which a desired position (target position) is determined and used in order to provide motorized movement of the frame 120 and cradles 122 to the target position. The linear positioning system 800 can be provided as an alternative to the linear positioning systems 500, 600, 700 of FIGS. 5-7, or can be combined therewith to provide an alternative control mode in which a desired position is used instead of force input for control of the motor 128.

The linear positioning system 800 is shown to include a user identification device 802 configured to identify a user to the controller 804. In some embodiments, the user identification device 802 is integrated into the apparatus 100, and can be a touchscreen or other interface that allows a user to input a username, identification number, user height, etc.

into the system for use by the controller 804. In other embodiments, the user identification device 802 includes a sensor and processing system configured to automatically identify the user (e.g., using facial recognition) or identify a trait of the user (e.g., measure a user's height). In yet other embodiments, the user identification device 802 is a personal computing device of a user (e.g., smartphone) running an application associated with the apparatus 100, and which is communicable with the controller 804 (e.g., via Bluetooth, Wi-Fi, etc.). The user identification device 802 can thereby provide identifying information (e.g., name, identity, height, etc.) relating to the user to the controller 804.

The controller 804 is shown as including a target position determination circuit 806 and a motor controller 808. The target position determination circuit 806 is configured to receive the identifying information from the user identification device 802 and determine a target position for the frame 120 based on the identifying information. For example, the target position determination circuit 806 may store user preferences for a list of users, and can determined the target position based on the user preferences for a user identified by the user identification device 802. In some such embodiments, the target position is determined as the last position of the frame 120 used by the identified user.

Figure 10:
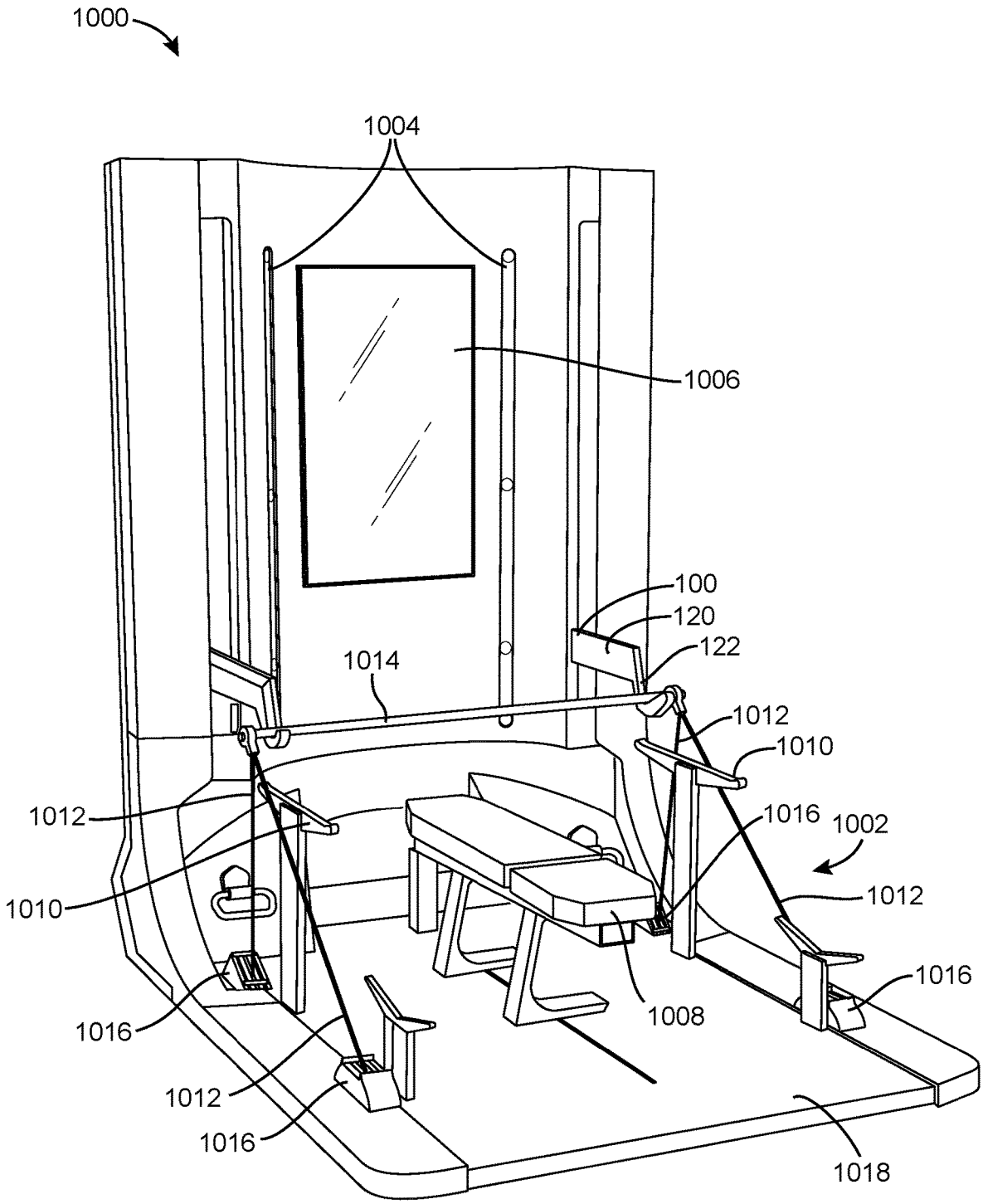
FIG. 10 is a perspective view of a fitness system including the strength-training apparatus of FIG. 1.

In some embodiments, the target position is determined based on the user's height or other physical characteristic. For example, the target position may be determined based on the user's height to move the cradles to a preferred position for initiation of an expected or planned exercise. In some embodiments, the circuit 806 determines the target position as a height suitable for a squat-type exercise based on the user's height (e.g., to a position slightly below the user's shoulders). In other embodiment, the target position determination circuit 806 receives a selection of a particular exercise (e.g., from a device mounted on apparatus 100, from a user's smartphone, from a processing system of a strength training system for example as shown in FIG. 10) and determines a proper position of the frame 120 for the selected exercise. The target position can be determined by the target position determination circuit 806 in a variety of ways in various embodiments.

The motor controller 808 receives the target position from the target position determination circuit 806 and controls a voltage provided to the motor 128 in order to cause the motor to move the frame 120 to the target position. A position sensor 810 is included in the embodiment shown in order to monitor and verify the position to facilitate the motor controller 808 in controlling the motor based on the target position. The position sensor 810 may be included in the motor (e.g., counting rotations at the motor) or positioned elsewhere on the apparatus 100 (e.g., to directly detect the position of the frame 120 relative to the stand 102). Once the target position is achieved (as verified using the position sensor 810), the motor controller 808 can control the motor 128 to hold the frame 120 at the target position.

The target position may be updated by the controller 804 in response to a change in user, a selection of a user (e.g. a selection of different exercise, a request for a different height), or some other change considered by the target position determination circuit 806. The motor controller 808 can then cause the motor 128 to move the frame 120 to an updated target position. As one advantageous scenario that can be provided by this approach, the linear positioning system 800 can automatically move the frame 120, cradles 122, and a barbell held by the cradles 122 to different positions preferred by different users alternating use of the same apparatus 100, which may be very helpful to exercise partners of different heights. As another advantageous scenario that can be provided by this approach, the linear positioning system 800 can sequentially and automatically move the frame 120, cradles 122, and a barbell held by the cradles 122 to different target positions in accordance with a sequence of different exercise in an exercise routine (program, class, workout, etc.).

Any combination of the features described with reference to FIGS. 5-8 should be considered to be within the scope of the present application. Additional functionality can be enabled by the combination of these features as well. For example the position sensor 810 can be used in the embodiments of FIG. 5-7 to provide for controls around the ends of the range of motion of the frame 120. The position sensor 810 can be used to reduce the motor voltage supplied to the motor 128 proximate the ends of the range of motion to slow and stop the frame before physical limits are met.

Figure 9:
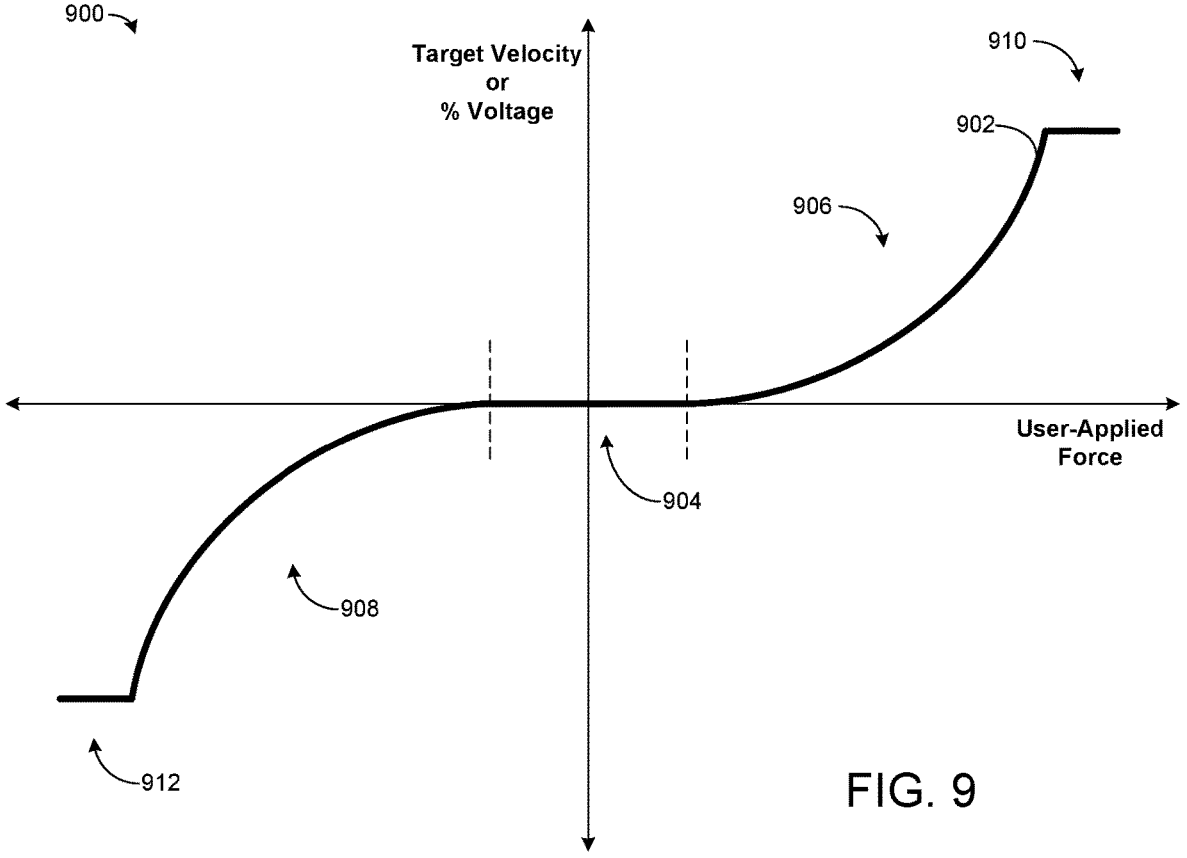
FIG. 9 is a graph of a function mapping a user-applied force to a target velocity or voltage percentage which may be used by a linear positioning system, according to an example embodiment.

Referring now to FIG. 9, a graphical representation 900 of a function that can be used by the controller 502 or the controller 702 to determine a target velocity or motor voltage as a function of the measured force from the force sensor 210 is shown, according to an example embodiment. FIG. 9 shows the user-applied force (measured force from the force sensor) on the horizontal axis and a target velocity or percentage of maximum voltage on the vertical axis. A line 902 represents the target velocity or percentage of maximum voltage as a function of the user-applied force.

In the example of FIG. 9, the line 902 illustrates that a deadband is provided in a region around zero applied force such that the velocity or voltage is set to substantially zero when the force is within the deadband (region 904, indicated by vertical dashed lines) and non-zero outside the deadband. For positive values of force outside the deadband (greater than a force threshold), the line 902 curves upwardly from zero such that velocity (or voltage) increases exponentially in a positive direction as force increases (region 906). For negative values of force outside the deadband (magnitude greater than a force threshold), the line 902 curves downwardly from zero such that velocity (or voltage) decreases exponentially (increases exponentially in magnitude while having a negative direction) as force decreases (increases in magnitude in a negative direction (region 908). In both directions, the velocity or voltage reaches a maximum and plateaus at the maximum value, e.g., at 100% of maximum voltage (regions 910 and 912).

As shown in FIG. 9, the function represented by line 902 provides substantially equivalent behavior of the linear positioning system in both the positive and negative directions. That is, the velocity and/or voltage varies in a negative direction with a force applied in the negative direction in substantially the same way that the velocity and/or voltage varies in a positive direction with a force applied in the positive direction. A user would thus experience consistent response of the linear positioning system in both directions, which may enhance usability. In other embodiments, such symmetry is not provided and the function is different in the positive direction compared to the negative direction.

The function shown in FIG. 9 is included for example purposes, and variations thereof may be included in various embodiments. For example, the size of the deadband and the degree of curvature in regions 906 and 906 may be different in various embodiments. In some cases, the function used in a particular implementation may be user-adjustable or selectable based on user preferences.

A function such as that shown in FIG. 9 provides for inherently stable control. If the conversion from applied force to velocity is too high, the frame 120 or other load (and the input assembly coupled thereto) will quickly move away from the user's hand, thus reducing the force and reducing the velocity.

Referring now to FIG. 10, a perspective view of a fitness system 1000 is shown, according to an example embodiment. The fitness system 1000 includes the strength training apparatus 100, in addition to additional features and systems configured to provide a full fitness experience, especially a resistance training experience. In particular, the fitness system 1000 includes the strength training apparatus 100 described above, a multi-cable force production system 1002, a pacing lighting system 1004, a display interface 1006, an integrated bench 1008, and adjustable rails 1010.

The multi-cable force production system 1002 can be configured as described in detail in U.S. patent application Ser. No. 16/909,003, filed Jun. 23, 2020 (now U.S. Pat. No. 11,504,570), the entire disclosure of which is incorporated by reference herein. The multi-cable force production system 1002 as shown here in FIG. 10 includes multiple (shown as four) cables 1012 connected to a barbell 1014 that can be supported by the cradles 122. The cables 1012 are connected to independent electric motors via separate pulleys 1016. The electric motors can be operated to independently vary the tension in each cable in order to create a desired force profile at the barbell 1014, as described in detail in the above-cited U.S. patent application Ser. No. 16/909,003 (now U.S. Pat. No. 11,504,570). The multi-cable force production system 1002 can also include platform 1018, which can include sensors as described in the above-cited U.S. patent application Ser. No. 16/909,003 (now U.S. Pat. No. 11,504,570).

The pacing lighting system 1004 can be configured as described in detail in U.S. patent application Ser. No. 17/010,573, filed Sep. 2, 2020 (published as U.S. Patent Application Publication No 2022/0062738), the entire disclosure of which is incorporated by reference herein. The pacing lighting system 1004 as shown here in FIG. 10 includes a pair of vertically-arranged rows of lighting element configured to illuminate dots (points, circles, areas) of different colors. The dots illuminated on the pacing lighting system 1004 can indicate to a user a desired/preferred range of motion for an exercise a real-time indication of the preferred position of the user (showing movement intended to be followed by the user), and a current position of the user (or barbell 1014) relative to that range of motion. As shown in FIG. 10, the pacing lighting system 1004 can be arranged parallel to the linear path along which the frame 120 can move, such that the pacing lighting system 1004 can illuminate points that correspond to heights relative to the frame 120. In some cases, control of the pacing lighting system 1004 and the linear positioning system for the frame 120 are coordinated so that an illuminated dot intended to guide the user's motion is aligned with the cradles 122 at the beginning and end of an exercise.

The display interface 1006 is configured to show various instructions, exercise data, resistance amounts, exercise routines, and other information to a user. The display interface 1006 may be a touchscreen to enable interaction between the user and the display interface 1006. For example, the display interface 1006 may be configured to accept user inputs requesting operations and changing settings for the strength training apparatus 100, force production system 1002, and/or pacing lighting system 1004. Various customized exercise programs and content can be provided via the display interface 1006, including as described in U.S. patent application Ser. No. 16/909,003 cited above and incorporated herein by reference.

The fitness system 1000 is also shown as including an integrated bench 1008 which can be selectively included or removed from the fitness system 1000 to enable exercises suitable for performance using a bench (e.g., bench press). The integrated bench 1008 may be configured to be coupled to the platform 1018 in some embodiments. The integrated bench 1008 can be adjustable to different inclinations for various exercises. In some embodiments, the integrated bench 1008 includes sensors or electronics to facilitate use of the integrated bench with other elements of the fitness system 1000.

The fitness system 1000 is also shown as including adjustable rails 1010. The adjustable rails 1010 are positioned below the cradles 122 and along sides of the platform 1018, and are configured to stop the bar from moving lower than height defined by the adjustable rails 1010. The adjustable rails 1010 can thus receive the barbell 1014 when a user is unable to complete an exercise or otherwise wishes to place the barbell 1014 somewhere other than in the cradles 122.

Various hardware and/or software of the various elements of the fitness system 1000 can be integrated and/or interoperable to provide for a comprehensive, unified experience for users of the fitness system 1000. For example the controller 502 described above can be provided as part of a control system for the fitness system 1000 that also controls the force production system 1002, the pacing lighting system 1004, and the display interface 1006. As one feature enabled by this integration, the force production system 1002 can be controlled in coordinate with the motorized movement of the cradles 122 by the linear positioning systems described above by either allowing the cables 1012 to be extended as the cradles 122 move upwards or by retracting slack in the cables 1012 as the cradles 122 move downwards, in response to user input via the force sensor 210. Various other integrations are also possible in various embodiments.

The foregoing description of embodiments has been presented for purposes of illustration and description. It is not intended to be exhaustive or to limit the disclosure to the precise form disclosed, and modifications and variations are possible in light of the above teachings or may be acquired from this disclosure. The embodiments were chosen and described in order to explain the principals of the disclosure and its practical application to enable one skilled in the art to utilize the various embodiments and with various modifications as are suited to the particular use contemplated. Other substitutions, modifications, changes and omissions may be made in the design, operating conditions and arrangement of the embodiments without departing from the scope of the present disclosure as expressed in the appended claims.

What is claimed is:

1. A strength training assembly, comprising:

a stand;

a frame movable along the stand in a vertical direction, the frame comprising a cradle configured to receive a barbell such that an upward force on the barbell lifts the barbell away from the cradle for performance of an exercise using the barbell;

a drive system coupled to the frame and controllable to affect a velocity of the frame relative to the stand;

a force sensor coupled to and movable with the frame, the force sensor configured to provide a signal indicative of force exerted on the force sensor by a user; and a controller configured to receive the signal from the force sensor and control the drive system such that the velocity of the frame varies as a function of the force exerted on the force sensor.

2. The strength training assembly of claim 1, wherein the drive system comprises:

an electric motor coupled to the stand; and a belt connected to the electric motor such that the electric motor is configured to cause rotation of the belt;

wherein the belt is coupled to the frame such that rotation of the belt causes movement of the frame relative to the stand.

3. The strength training assembly of claim 1, wherein:

the stand comprises a vertical rail; and the frame is slideably mounted on the vertical rail.

4. The strength training assembly of claim 1, wherein the force sensor is static relative to the frame, and wherein the barbell is configured to move relative to the force sensor during the performance of the exercise using the barbell.

5. The strength training assembly of claim 1, wherein the controller is configured to control the drive system such that the velocity of the frame varies as the function of an amount and direction of the force exerted on the force sensor by controlling the drive system to provide an exponential relationship between the amount of force exerted on the force sensor and the velocity of the frame.

6. The strength training assembly of claim 5, wherein controlling the drive system to provide the exponential relationship between the amount of force exerted on the force sensor and the velocity of the frame further comprises providing a deadband such that the controller causes the drive system to prevent movement of the frame when the amount of force exerted on the force sensor is less than a threshold magnitude.

7. The strength training assembly of claim 1, wherein the strength training assembly further comprising a digital force production system coupled to the stand and different than the drive system operable to affect the velocity of the frame relative to the stand, the digital force production system comprising:

a plurality of cables coupled to the barbell, the barbell configured to be selectively received by and removed from the pair of cradles with the plurality of cables remaining coupled to the barbell when the barbell is removed from the pair of cradles; and a plurality of actuators configured to provide tension to the plurality of cables.

8. A linear positioning system, comprising:

a load mounted on a rail;

an actuator controllable to cause movement of the load along the rail;

a force sensor rigidly coupled to the load such that the force sensor moves with the load, wherein the force sensor is configured to measure an amount of force exerted on the force sensor by a user; and a controller configured to control the actuator to provide the load with a velocity that varies as a function of the amount of force measured by the force sensor, wherein the load comprises a pair of cradles configured to receive and support a barbell such that an upward force on the barbell lifts the barbell away from the pair of cradles without affecting the force on the force sensor.

9. The linear positioning system of claim 8, wherein the function comprises an exponential function of the amount of force.

10. The linear positioning system of claim 8, wherein the controller is configured to control the actuator such that:

when the amount of the force is within a deadband, the velocity is zero; and when the amount of the force is outside the deadband, a magnitude of the velocity increases continuously as the amount of force increases.

11. The linear positioning system of claim 10, wherein the force sensor is configured to determine whether the force is exerted on the force sensor in a first direction or a second direction opposite the first direction; and wherein the controller is configured to control the actuator such that:

when the force is in the first direction, the velocity is in the first direction; and when the force is in the second direction, the velocity is in the second direction.

12. The linear positioning system of claim 8, wherein the controller is configured to:

calculate a target velocity based on the amount of force exerted on the force sensor using the function; and cause the velocity of the load to track the target velocity.

13. The linear positioning system of claim 12, further comprising a velocity sensor configured to determine the velocity of the load, wherein the controller is configured to provide enable feedback control based on the target velocity and measurements from the velocity sensor.

14. The linear positioning system of claim 8, wherein the actuator comprises an electric motor.

15. The linear positioning system of claim 14, wherein the controller is configured to control the actuator by varying a voltage provided to the electric motor based on a magnitude of a signal received from the force sensor.

16. The linear positioning system of claim 8, wherein the barbell is coupled to a force production system comprising a plurality of cables, wherein tension in the plurality of cables provides resistance for an exercise using the barbell separate from operation of the actuator.

17. A strength training assembly, comprising:

a stand;

a frame movable along the stand in a first direction and an opposite second direction, the frame comprising a pair of cradles configured to receive a barbell;

an electric motor operable to provide motorized adjustment of a position of the frame relative to the stand to adjust a starting position of the barbell for an exercise, wherein the barbell is lifted out of the cradles by a user during performance of the exercise; and a digital force production system coupled to the stand and different than the electric motor operable to provide motorized adjustment of the position of the frame relative to the stand, the digital force production system comprising:

a plurality of cables coupled to the barbell, the barbell configured to be selectively received by and removed from the pair of cradles with the plurality of cables remaining coupled to the barbell when the barbell is removed from the pair of cradles; and a plurality of actuators configured to provide tension to the plurality of cables.

18. The strength training assembly of claim 17, further comprising a controller configured to:

determine a target for the position of the frame based on a selected exercise or a user profile; and control the electric motor to adjust the position of the frame to match the target.

19. The strength training assembly of claim 17, further comprising a user input device mounted on the frame and configured to allow the user to request movement of the frame by the electric motor.

20. The strength training assembly of claim 19, wherein the electric motor is configured to prevent movement of the frame relative to the stand unless the user input device is engaged by the user.

21. The strength training assembly of claim 17, wherein the frame is movable by the electric motor while the barbell is supported by the pair of cradles.

* * * * *